United States Patent [19]

Litman

[11] 4,030,421

[45] June 21, 1977

[54] DUAL PURPOSE PROJECTILE AND WEAPON COMBINATION

[75] Inventor: Alan Litman, Pittsburgh, Pa.

[73] Assignee: Smith & Wesson Chemical Company, Inc., Pittsburgh, Pa.

[22] Filed: July 2, 1976

[21] Appl. No.: 702,173

Related U.S. Application Data

[60] Continuation of Ser. No. 590,540, June 26, 1975, abandoned, which is a division of Ser. No. 485,560, July 3, 1974, abandoned.

[52] U.S. Cl. ..... 102/92.3; 102/62; 244/3.27

[51] Int. Cl.[2] ..... F42B 11/36

[58] Field of Search ..... 102/34.1, 92.3, 92.1, 102/92.2, 67, 62, 93; 244/3.27, 3.28, 3.29

[56] References Cited

UNITED STATES PATENTS

| | | | |
|---|---|---|---|
| 35,503 | 6/1862 | Browne | 102/62 X |
| 1,166,879 | 1/1916 | Alard | 244/3.29 |
| 1,201,763 | 10/1916 | Rimailho | 244/3.28 X |
| 1,243,542 | 10/1917 | Moore | 244/3.27 |
| 1,330,079 | 2/1920 | Kobuchi | 102/62 |
| 3,098,445 | 7/1963 | Jackson | 102/34.1 X |
| 3,347,491 | 10/1967 | Pickart | 244/3.27 |
| 3,598,057 | 8/1971 | Potter | 102/93 X |
| 3,782,286 | 1/1974 | Jones et al. | 244/3.27 X |
| 3,898,932 | 8/1975 | Flatau et al. | 102/93 X |

FOREIGN PATENTS OR APPLICATIONS

| | | | |
|---|---|---|---|
| 751,183 | 6/1956 | United Kingdom | 244/3.28 |

*Primary Examiner*—David H. Brown
*Attorney, Agent, or Firm*—Patrick J. Walsh

[57] ABSTRACT

Disclosed is a dual purpose projectile and weapon combination whereby an individual can select one of two different projectile configurations and consequent performance characteristics when firing a single projectile from the weapon. In one projectile configuration, the projectile has a conventional bullet-shaped body and a frontal area corresponding to its caliber. This projectile is fired conventionally with normal velocity and obtains conventional performance characteristics. In the other projectile configuration, the projectile is configured to provide a low velocity short-range large frontal area missile having minimal penetration with high impact to obtain a disabling effect.

4 Claims, 9 Drawing Figures

Fig. 3.
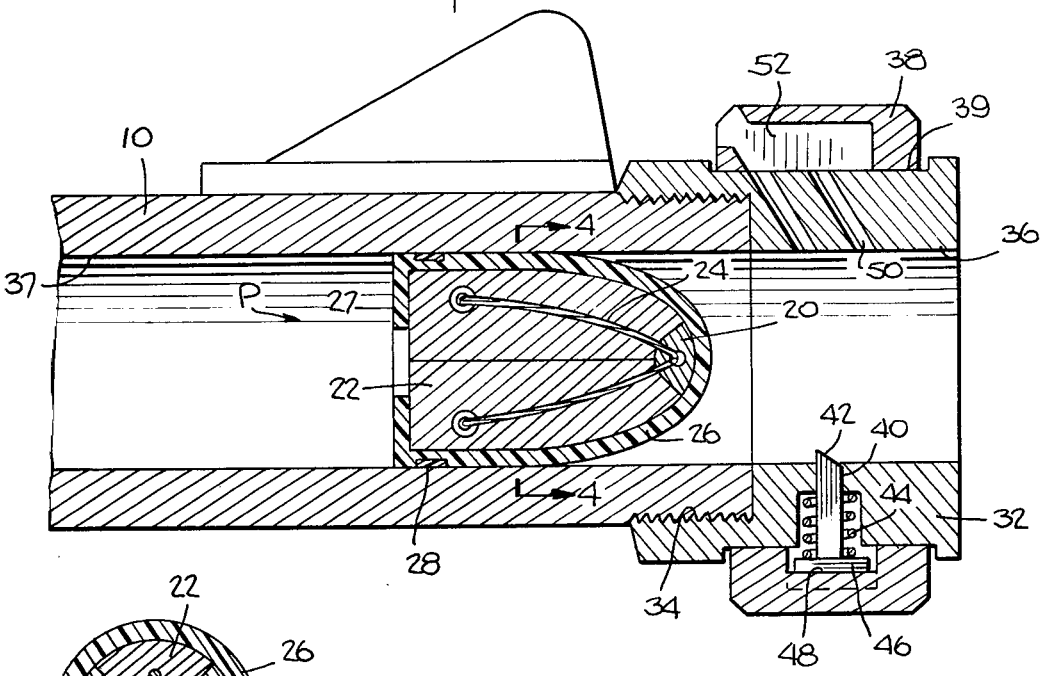
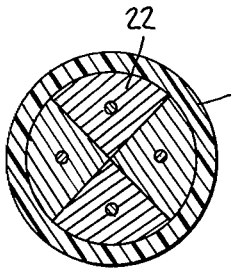
Fig. 4.
Fig. 5.
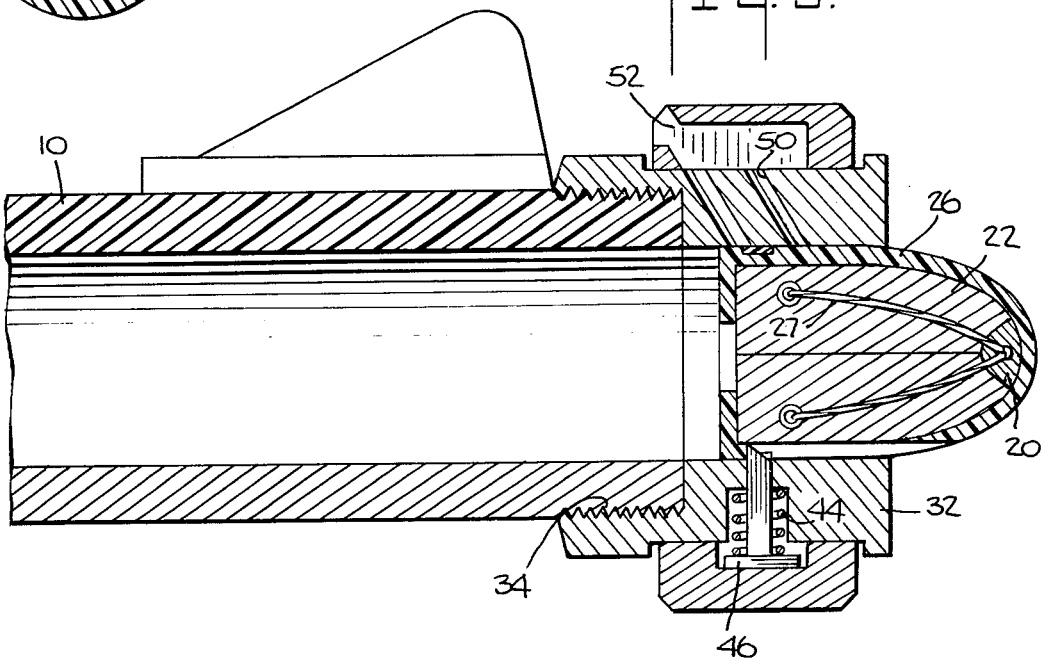

10
20
22
26
27
28
34
38
40
42
44
46
48
50
52
9

DUAL PURPOSE PROJECTILE AND WEAPON COMBINATION

This application is a continuation of application Ser. No. 590,540 filed June 26, 1975 now abandoned which was a division of prior application Ser. No. 485,560 filed July 3, 1974 now abandoned.

The present invention relates to a dual purpose projectile and weapon combination and particularly relates to a projectile/weapon combination which enables an individual to select from two projectile configurations with different performance characteristics when firing a single projectile from the weapon.

In many situations, particularly those confronting a law enforcement officer, it is oftentimes desirable to utilize a cartridge firing weapon, for example a revolver, which, when fired, would not result in a fatal injury but which would be sufficient to disable or knock down an individual. Too often the law enforcement officer is confronted with the choice between not using his conventional service revolver or using such revolver with the attendant high risk of causing serious or fatal injury. High frontal area projectiles providing high impact for disabling an individual or knocking him down have previously been provided. These projectiles, however, function only in a single mode. That is, the individual or law enforcement officer utilizing such high impact projectile must unload conventional ammunition from his weapon, and preload the weapon with such high impact projectiles in full anticipation of using the high impact projectile instead of the conventional projectile. Very often, however, the situation arises where there is no time to first unload conventional ammunition from the revolver and then load the weapon with high impact projectiles and fire the weapon. Conversely, the individual or law enforcement officer cannot quickly and readily convert the weapon from one loaded for firing high impact projectiles back to one loaded for firing normal high velocity penetration projectiles. The use of such high impact projectiles prior to the present invention required anticipatory knowledge of the type of situation in which such high impact projectiles were required and such anticipatory knowledge cannot very often be realistically obtained.

Consequently, there has developed the need for a dual purpose projectile and weapon combination wherein the individual or law enforcement officer can select the performance characteristics of a single projectile, i.e., either for low velocity high impact or high velocity high penetration, and which selection can be accomplished quickly and efficiently and without the necessity for unloading or reloading the weapon. To accomplish this in accordance with the present invention, the present invention provides a projectile comprised of a pluraity of axially extending segments disposed preferably at equally circumferentially spaced locations about the longitudinal axis of the projectile and connected by flexible elements to a nosepiece. The segment and nosepiece are normally maintained in a bullet-shaped configuration by a jacket which carries a retaining band thereabout. The flexible elements connecting the nosepiece and segments are preferably spring biased to extend the segments in a substantially radial direction from the nosepiece. With the band retaining the segments in their axial orientation and in close circumferential juxtaposition about the projectile axis, the segments and nosepiece form a substantially bullet-shaped projectile body which can be fired from the weapon as a normal high velocity penetration round. The projectile can also be fired from the weapon and assume a second configuration wherein the segments extend substantially radially from the nosepiece. This latter projectile configuration provides a low impact high frontal area missile of reduced velocity for purposes of disabling or knocking down an individual.

To preselect the configuration of the projectile prior to firing the weapon, the weapon is provided with an attachment which preferably screw threads on the end of the weapon's barrel. The attachment includes a rotatable selector ring having an inner cam surface. The attachment body includes an extension or a continuation of the barrel of the weapon and a cutter which is radially movable into and out of the extended barrel passage. The cutter is preferably spring biased into a retracted position radially outwardly of the extended barrel passage and is movable radially inwardly into such passage by a camming action against the cutter in response to rotation of the selector ring.

When it is desired to fire a normal high velocity penetration round, the selector ring is rotated such that the spring withdraws the cutter from the extended barrel passage. This enables the projectile, when fired from the weapon, the move along its trajectory in a bullet-shaped configuration, the segments being retained in such bullet-shaped configuration by the retaining band. When it is desired to fire the projectile in a mode to achieve a high impact low velocity configuration, the selector ring is rotated to cam the cutter into the extended barrel passage. When the weapon is fired, the cutter severs the retaining band as the projectile issues from the barrel. Severance of the retaining band enables the segments to move radially outwardly of the nosepiece whereby the projectile assumes a substantially propeller-like configuration. Movement of the selector ring to achieve the latter projectile configuration, also uncovers vent openings in the attachment whereby the pressure in the cutter area of the barrel extension is relieved and reduced muzzle velocity is obtained.

With the foregoing described dual purpose projectile and weapon, the individual or law enforcement officer may rapidly, readily and easily select the configuration of projectile to be fired from his weapon simply by rotating the selector ring to one or the other of two positions. No unloading of other ammunition or reloading of the desired ammunition is necessary to achieve the desired projectile configuration since a single projectile assumes one of the two configurations by simple manual rotation of the selector ring.

Accordingly, it is a primary object of the present invention to provide a novel and improved dual purpose projectile and weapon combination.

It is another object of the present invention to provide a novel and improved dual purpose projectile which can be utilized either as a high velocity penetration round or a low velocity high impact round as desired.

It is still another object of the present invention to provide a novel and improved weapon for firing a dual purpose projectile wherein an individual or law enforcement officer can readily, easily and quickly select the configuration of the projectile to be fired from the weapon from two potential modes, either a high velocity penetration round or a low velocity high impact round.

It is a further object of the present invention to provide an attachment to conventional weapons whereby the dual purpose projectile hereof can be utilized in conventional weapons with only slight modification thereof necessary to secure the attachment to the weapon.

It is a still further object of the present invention to provide a dual purpose projectile and weapon combination which affords a choice between firing a high velocity penetration round and a low velocity high impact round.

These and further objects and advantages of the present invention become more apparent upon reference to the following specification, appended claims and drawings wherein:

FIG. 3 is an enlarged cross-sectional view of the barrel of a weapon employing the dual purpose projectile hereof and illustrating the projectile as it passes through the barrel of the weapon and the barrel attachment;

FIG. 4 is a cross-sectional view thereof taken generally about on line 4—4 in FIG. 3;

FIG. 5 is a view similar to FIG. 3 illustrating the projectile as it issues from the barrel attachment with the selector ring located to provide a projectile having low velocity high impact characteristics;

Figure 1:
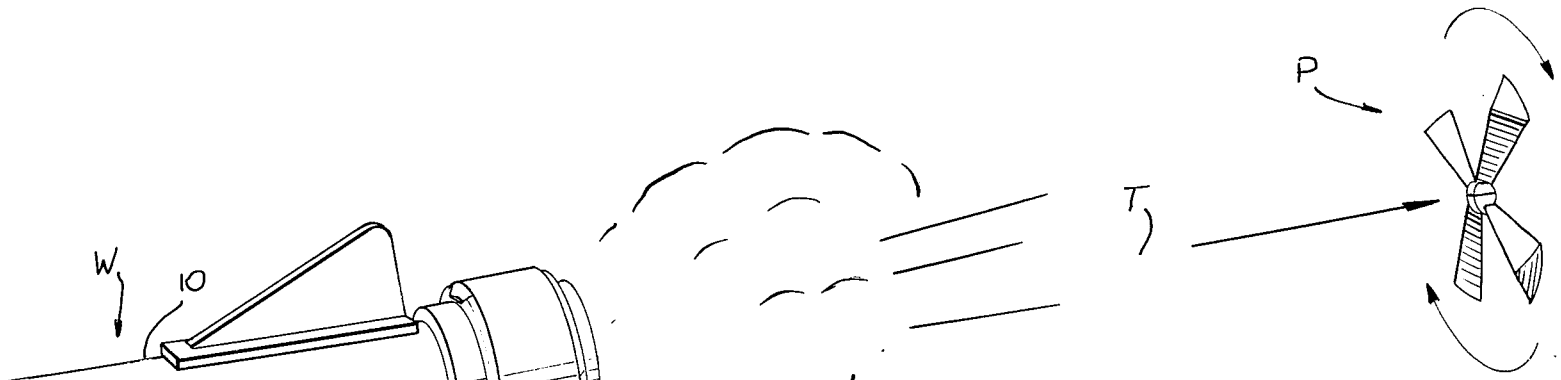
FIG. 1 is a fragmentary perspective view of a combined dual purpose projectile and weapon combination illustrating the projectile in a low velocity high impact configuration.
Figure 2:
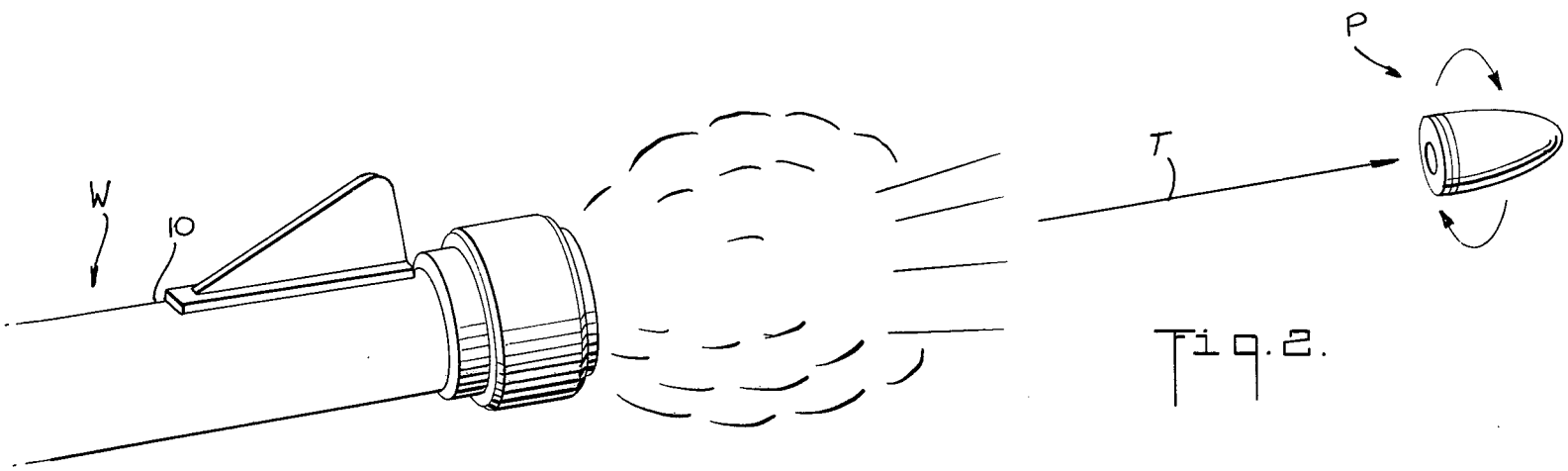
FIG. 2 is a view similar to FIG. 1 illustrating the projectile in a high velocity penetration configuration.

Referring now to the drawings, and particularly to FIG. 1, there is illustrated the barrel 10 of a weapon generally designated W. The arrow T denotes the trajectory of a projectile P as it issues from the barrel 10 of weapon W. In FIG. 1, the projectile is illustrated in a low velocity high impact mode or configuration as it moves along its trajectory. FIG. 2 illustrates the projectile P in a high velocity penetration mode or configuration as it moves along its trajectory T.

Figures 6, 7, 8, 9:
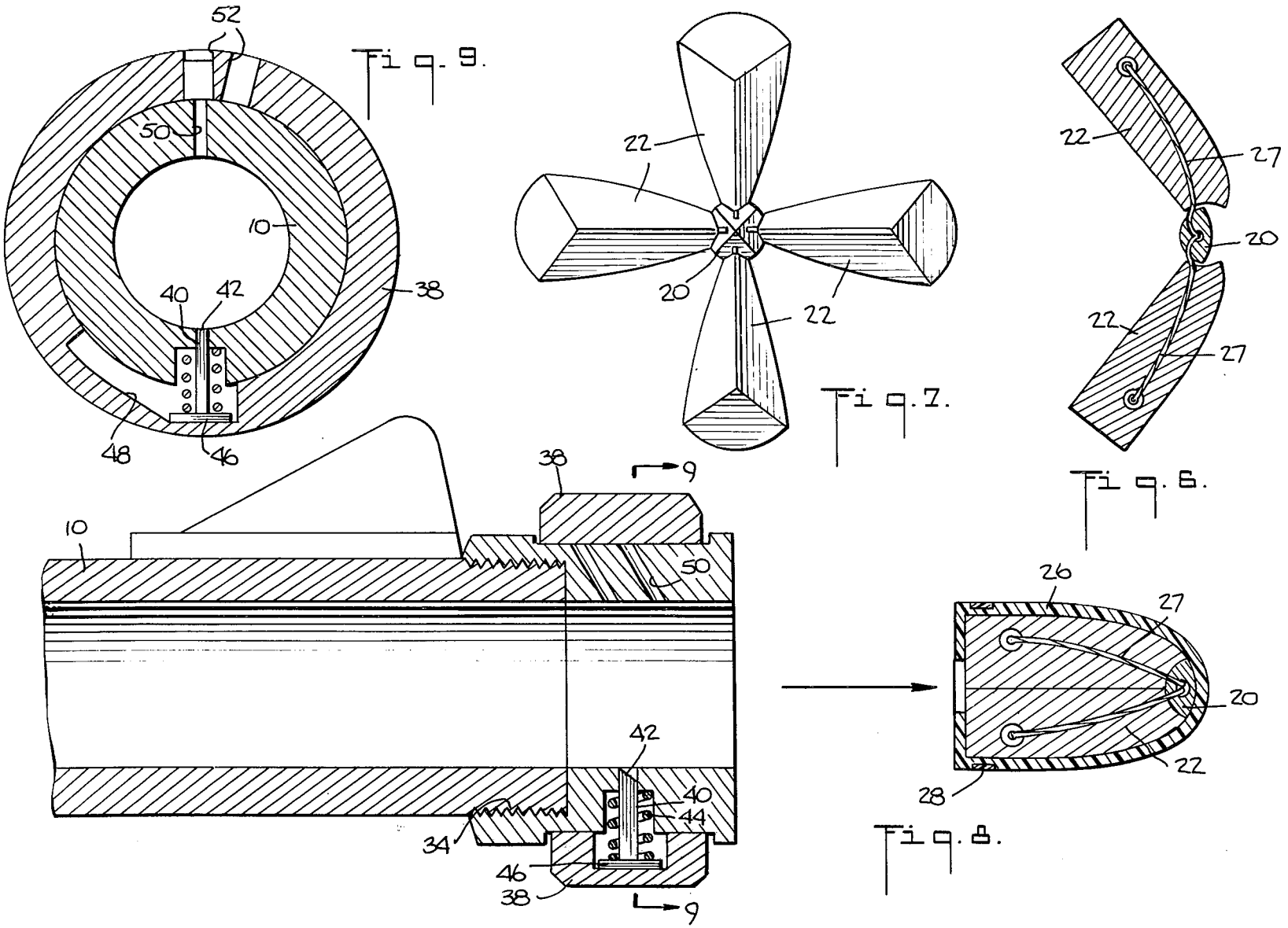
FIG. 6 is a cross-sectional view of the projectile in its low velocity high impact configuration.
FIG. 7 is a rear view thereof taken normal to the trajectory of the projectile.
FIG. 8 is a view similar to FIG. 3 and illustrates the barrel attachment in a mode for firing a high velocity penetration round from the weapon.
FIG. 9 is a cross-sectional view thereof taken generally about on line 9—9 in FIG. 8.

Referring now to FIGS. 3 and 6, the projectile P is comprised of a nosepiece 20 and a plurality of projectile segments 22. As illustrated in FIG. 3, segments 22 are axially oriented about the longitudinal central axis of the projectile and lie preferably at equally spaced circumferential positions about the projectile axis. Four segments 22 are illustrated although it will be appreciated that a fewer or greater number of such segments may be provided to form the projectile body. Segments 22 are connected to nosepiece 20 by flexible elements 24. Preferably, each element 24 comprises a hairpin-like spring member or a braided high strength wire which serves as a hinge between the segments 22 and nosepiece 20. From a review of FIG. 3, it will be appreciated that the rear surface of nosepiece 20 is generally spherical and that the forward ends of the segments 22 are concave in general conformance thereto to enable a smooth hinging action when the projectile converts from the bullet-shaped projectile body configuration illustrated in FIG. 3 to its high impact low velocity projectile configuration illustrated in FIG. 6. The segments and nosepiece may be fabricated from lead, pressed and sintered tungsten or a tungsten powder aggregate in a lead matrix with the elements 24 being embedded in the segments. To facilitate the hinging action, the openings from the rear surface of nosepiece 20 may be conically shaped.

Formed about segments 22 when they lie axially of the projectile, i.e., when the projectile lies in its bullet-shaped body configuration, is a jacket 26 which encompasses the sides and forward portions of the segments and nosepiece 20. Jacket 26 has an annular flange 27 which partially covers the rear surface of segments 22. While the jacket may comprise a unitary covering, preferably formed of Teflon or polyethylene, it may also be segmented similarly as segments 22. To retain segments 22 in the bullet-shaped configuration illustrated in FIGS. 3 and 8, a band 28 encompasses segments 22 and jacket 26 adjacent the rear portion of projectile P. The segments are normally enclosed by such band and preferably the band is formed of a nylon or glass filament. As illustrated, band 28 lies flush with the outer surface of jacket 26.

Referring now particularly to FIGS. 3 and 9, there is provided an attachment for a standard weapon W whereby the projectile configuration can be readily and easily selected by the user of the weapon. The attachment includes an annular body 32 counterbored and threaded at one end as at 34 for threaded connection with the externally threaded end of barrel 10 of weapon W. It will be appreciated that body 32 may be formed integrally with the barrel of the weapon rather than as an attachment thereto. The central passage 36 through attachment 32 when the latter is applied to weapon W constitutes an axial barrel extension of the barrel bore 37. A selector ring 38 is provided about barrel attachment 32 and is rotatable in a groove 39 formed about the outer surface of attachment body 32 whereby ring 38 is retained on attachment 32.

As best illustrated in FIG. 9, attachment 32 slidably carries a pin 40, the inner end of which constitutes a cutting blade 42. Pin 40 is mounted for radial movement relative to the extended barrel passage 36 and is normally biased into a position such that the cutter blade 42 is retracted from the extended barrel passage 36. That is, one end of a compression spring 44 engages the head 46 of pin 40 while its opposite end bears against a shoulder formed on attachment body 32 whereby pin 40 is biased for radial outward movement. The inner surface of ring 38, as best illustrated in FIG. 9, is recessed to form a cam surface 48. Cam surface 48 slopes radially inwardly as it extends circumferentially about the inner surface of the recess. Consequently, when the ring 38 is rotatably positioned as illustrated in FIG. 9 with the portion of the cam surface 48 spaced farthest from the axis of the extended barrel bore, the cutter blade 42 of pin 40 is fully retracted from the extended barrel passage 36 by spring 44. Upon rotation of ring 38 for example in a counterclockwise direction as illustrated in FIG. 9, the cam surface 48 urges pin 40 radially inwardly against the bias of spring 44 to locate cutter blade 42 within the extended barrel passage 36 and adjacent a peripheral surface thereof.

Diametrically opposed to pin 40 are a pair of axially spaced vent apertures 50 which open through attachment body 32. A rearwardly opening aperture 52 is formed in selector ring 38 for alignment with the vent apertures 50 when selector ring 38 is moved into the position illustrated in FIG. 3 with cutter blade 42 projecting into the extended barrel passage 36. Thus, when the selector ring lies in the position illustrated in FIG. 9 with the cutter blade fully retracted, aperture 50 is radially misaligned with apertures 52 and venting is precluded. When the selector ring 38 is rotated to a position projecting cutter blade 42 into the confines of barrel extension 36, i.e., FIG. 3, vent apertures 50 and aperture 52 are radially aligned and this relieves the gas pressure in the barrel when the weapon is fired whereby the vent apertures serve as a muzzle brake.

To utilize the dual purpose projectile and weapon combination hereof, the weapon is loaded with the projectiles in their bullet-shaped configuration, for example in the projectile configuration illustrated in FIGS. 3 and 8. The individual or law enforcement officer may then select the configuration in which the projectile will move along its trajectory toward its target, either as a bullet-shaped projectile having high velocity and high penetration characteristics or as a substantially propeller-shaped low velocity high impact projectile. To fire the projectile in the high velocity and high penetration bullet-shaped mode, the individual or law enforcement officer rotates the selector ring 38 to a position enabling spring 44 to retract pin 40 and cutter blade 42 from the extended barrel passage 36. Thus, the passage 36 constitutes a smooth bore extension of barrel bore 37 enabling projectile P to be fired from the weapon in a conventional manner. Thus, segments 22 are retained in their collapsed positions as illustrated in FIG. 8 by the band 28 and the projectile performs in a manner similar to a conventional bullet having high velocity and penetration characteristics. To fire the projectile in a mode wherein the projectile achieves low velocity, high impact and non-penetration characteristics for disabling an individual, the law enforcement officer rotates selector ring 38 in a direction, for example in a counterclockwise direction as illustrated in FIG. 9, enabling cam surface 48 to urge pin 40 radially inwardly against the bias of spring 44. This projects cutter blade 42 within the extended barrel passage 36 at a location adjacent its margin. When projectile P is fired and passes through extended barrel passage 36, cutter blade 42 cuts through the jacekt 26 and severs retaining band 28. Severance of the retaining band 28 enables segments 22 to separate one from the other and particularly enables the segments to pivot about the nosepiece into substantially radially extending positions about the projectile axis substantially as shown in FIGS. 6 and 7. It will be noted particularly from FIG. 7 that segments 22 obtain a substantially symmetrical configuration about the projectile axis.

In one form hereof, the flexible elements 24 connecting segments 22 to nosepiece 20 constitute spring members whereby segments 22 are biased outwardly into their substantially radially projecting positions. In another form, the flexible elements constitute wires, which do not bias the segments. The segments open, however, by centrifugal force to form a propeller-like wheel. When the projectile opens substantially as illustrated in FIG. 1, the segments and nosepiece rotate about an axis coincident with the trajectory of the projectile as a consequence of the rotation imparted to the projectile by the rifling of the gun barrel. The increased frontal area of the projectile and its rotation reduce the projectile velocity. Also, when selector ring 38 is rotated to fire a round obtaining in this configuration, vent apertures 50 and 52 are aligned whereby the gas pressure is relieved and the muzzle velocity is reduced.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A dual purpose projectile for firing from a weapon comprising a body including a forward nose portion and a pluraity of body segments, means located adjacent the nose of said projectile securing said segments one to the other for movement between first and second configurations, said segments in said first configuration being disposed in close juxtaposition one to the other and forming a substantially bullet-shaped projectile body having a predetermined diameter, said bullet-shaped projectile body having a longitudinal axis, said segments in said first configuration thereof being circumferentially spaced one from the other about said axis, said segments in said second configuration being spaced one from the other and forming a projectile body having a diameter larger than said predetermined diameter affording increased frontal area in a direction normal to the trajectory of the projectile when fired from the weapon, and means for releasably retaining said segments in said first configuration, said retaining means including a band encompassing said segments in the first configuration thereof adjacent the end of said projectile remote from its nose.

2. A dual purpose projectile for firing from a weapon comprising a body including a plurality of body segments, means securing said segments one to the other for movement between first and second configurations, said segments in said first configuration being disposed in close juxtaposition one to the other and forming a substantially bullet-shaped projectile body having a predetermined diameter, said bullet-shaped projectile body having a longitudinal axis, said segments in said first configuration thereof being circumferentially spaced one from the other about said axis, said segments in said second configuration being spaced one from the other and forming a projectile body having a diameter larger than said predetermined diameter affording increased frontal area in a direction normal to the trajectory of the projectile when fired from the weapon, and means for releasably retaining said segments in said first configuration, said projectile including a jacket about said segments in the first position thereof, said retaining means including a band encompassing said jacket and said segments, and said band lying substantially flush along the outer surface of said jacket.

3. A dual purpose projectile for firing from a weapon comprising a body including a forward nose portion and a plurality of body segments, means securing said segments one to the other for movement between first and second configurations, said securing means including a nosepiece and flexible elements interconnecting said nosepiece and said segments adjacent the nose of said projectile, said segments in said first configuration being disposed in close juxtaposition one to the other and forming a substantially bullet-shaped projectile body having a predetermined diameter, said bullet-shaped projectile body having a longitudinal axis, said segments in said first position thereof being circumferentially spaced one from the other about said axis, said segments extending in an axial direction substantially coextensive in length with the length of said bullet-shaped body when said segments lie in said first configuration, said segments in said second configuration being spaced one from the other and forming a projectile body having a diameter larger than said predetermined diameter affording increased frontal area in a direction normal to the trajectory of the projectile when fired from the weapon, and means for releasably retaining said segments in said first configuration, said retaining means including a band encompassing said segments in said first configuration thereof adjacent the end of said projectile body remote from said nosepiece, said segments in said second configuration thereof extending substantially radially relative to said axis and disposed at substantially equally spaced circumferential locations about said axis.

4. A projectile according to claim 3 including a jacket about said segments in the first position thereof, said band extending about said jacket and said segments with said band lying substantially flush along the outer surface of said jacket.

* * * * *